United States Patent [19]

Ooms

[11] Patent Number: 4,868,452

[45] Date of Patent: Sep. 19, 1989

[54] ELECTRIC AMP HAVING A FLEXIBLE CONDUCTOR CONNECTING A PLURALITY OF EXTERNAL PINCH SEAL CONDUCTORS TO A RIGID CURRENT-SUPPLY CONDUCTOR

[75] Inventor: Leo F. M. Ooms, Turnhout, Belgium

[73] Assignee: U.S. Philips Corporation, New York, N.Y.

[21] Appl. No.: 191,506

[22] Filed: May 9, 1988

[30] Foreign Application Priority Data

May 26, 1987 [NL] Netherlands ..... 8701252

[51] Int. Cl.[4] ..... H01J 17/18; H01R 17/00

[52] U.S. Cl. ..... 313/318; 439/611; 439/617; 439/618

[58] Field of Search ..... 313/318; 439/611, 617, 439/618

[56] References Cited

U.S. PATENT DOCUMENTS 3,829,729 8/1974 Westlund, Jr. et al. ..... 313/318 X 4,084,112 4/1978 Hebert et al. ..... 313/318 X 4,499,404 2/1985 Walsh ..... 313/579

OTHER PUBLICATIONS

The American Heritage Dictionary, (2nd Ed.), (1982), pp. 513, 1051–1052.

Handbook of Chemistry and Physcia (52nd Ed.) (1971–2), pp. 13–21.

*Primary Examiner*—Donald J. Yusko

*Assistant Examiner*—Sandra L. O'Shea

*Attorney, Agent, or Firm*—Brian J. Wieghaus

[57] ABSTRACT

The electric lamp has a lamp vessel (1) having a pinched seal (2) in which a metal foil (3) is accommodated as current lead-through conductor, which is connected to several external current conductors (7). The current conductors (7) are secured via a metal strip (8) to a current supply wire (14). Thus, deformations of the external current conductors (7) are avoided, which lead to mechanical stresses in the pinched seal (2) and to rupture thereof.

10 Claims, 2 Drawing Sheets

ELECTRIC AMP HAVING A FLEXIBLE CONDUCTOR CONNECTING A PLURALITY OF EXTERNAL PINCH SEAL CONDUCTORS TO A RIGID CURRENT-SUPPLY CONDUCTOR

BACKGROUND OF THE INVENTION

The invention relates to an electric lamp of the type having a light source within a lamp vessel which is sealed in a vacuum-tight manner has a pinched seal at one end. The lamp vessel may consist of glass having an $SiO_2$ content of at least 95% by weight.

At least one metal foil with a first and a second end accommodated in the pinched seal serves as current lead-through conductor, the metal foil is connected near its first end to an internal current conductor extending to the light source and connected near its second end to several external current conductors emanating from the pinched seal.

The pinched seal being fixed in a said lamp cap provided with an electrical contact.

A current supply wire or conductor connected to the electrical contact of the lamp cap and to the said several external current conductors. Such an electric lamp is known from U.S. Pat. No. 4 499 404.

The known lamp is an incandescent lamp having only one pinched seal, in which two metal foils are accommodated, which are each connected to a respective internal current conductor and to a respective pair of external current conductors. At right angles to the external current conductors a respective current supply wire is welded to each pair of external current conductors.

By using more than one external current conductor per metal foil, the current density in the external current conductors and in the welds of said conductors to the metal foils is decreased and hence the heat development in the pinched seal is reduced.

As the number of external current conductor is larger, however, the risk is greater than they are not all located in a flat plane. When welding connections are made, external current conductors can then be elastically deformed, as a result of which they produce mechanical stresses in the pinched seal. These stresses can lead to rupture of the pinched seal and to leakage of the gas fill from the lamp vessel.

SUMMARY OF THE INVENTION

The invention has for its object to provide an electric lamp of the kind mentioned in the opening paragraph having a construction which reduces the risk of the mechanical stresses in the pinched seal.

According to the invention, this object is achieved in that the external current conductors are connected to the current supply wire via a flexible metal strip.

By interposition of a metal strip between the external current conductors and the current supply wire, a flexible coupling is obtained between said conductors and said wire, which results in reduced stresses in the pinched seal.

In a favorable embodiment, fingers are formed by incisions in the metal strip and each external current conductor is connected to a respective finger of the strip. The strip can then more readily be adapted to the positions of the external current conductors, while nevertheless only one additional component need be used for the current supply wire.

Also with the use of a respective strip per external current conductor, a very flexible coupling is obtained.

It is also favorable when in a particular embodiment the (respective) metal strip extends from the free end of the external current conductors to the pinched seal and is connected near the pinched seal to the current supply wire. This embodiment has the advantage that the space in the lamp cap is substantially not larger than in a lamp in which the step according to the invention has not been taken.

In a variation of this embodiment, the (respective) metal strip is bent into the form of a U, which increases the flexibility of the coupling.

The construction of the lamp according to the invention is particularly suitable for lamps consuming a very high power, for example a power of a few thousand Watts, such as incandescent lamps having a planar filament. These lamps generally have only one pinched seal.

BRIEF DESCRIPTION OF THE DRAWINGS

Embodiments of the lamp according to the invention are shown in the drawing. In the drawing.

DESCRIPTION OF THE PREFERRED EMBODIMENTS

Figure 1:
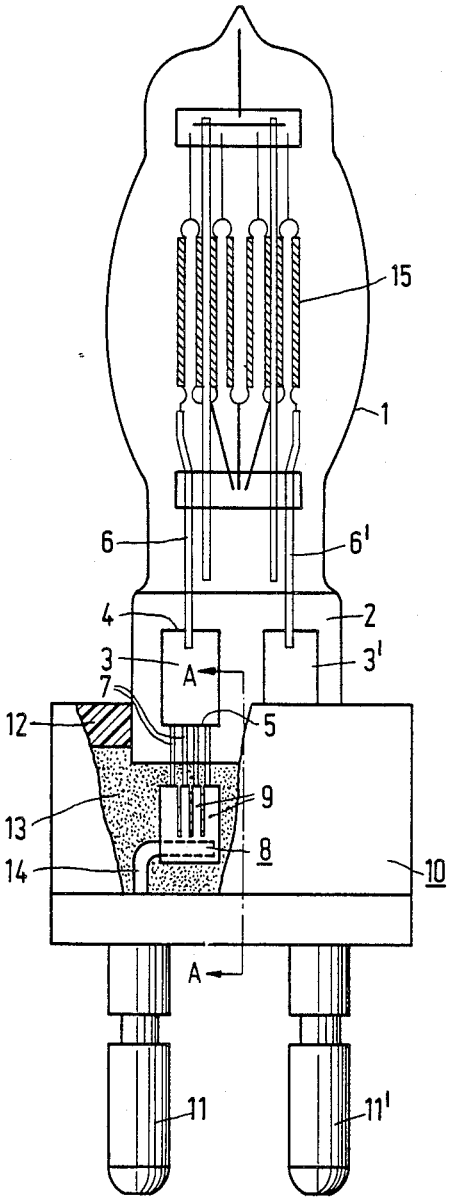
FIG. 1 is a front elevation of a lamp, in which the lamp cap is partly broken away.

In FIG. 1, the lamp has a lamp vessel 1 sealed in a vacuum-tight manner and consisting of glass having an $SiO_2$ content of at least 95% by weight, for example quartz glass. The lamp vessel 1 has at one end a pinched seal 2. A planar filament 15 is arranged as a light source within the lamp vessel 1.

A metal foil 3 (3') having a first end 4 and a second end 5 is accommodated as a current lead-through conductor in the pinched seal 2. The metal foil 3 (3') is connected near its first end 4 to an internal current conductor 6 (6') extending to the light source 15 and near its second end 5 to several external current conductors 7 emanating from the pinched seal 2.

The lamp has a lamp cap 10 mainly consisting of ceramic material provided with pins 11,11' as electrical contacts. The lamp vessel 1 is fixed with its pinched seal 2 in the lamp cap 10 by means of cement 12. The lamp cap 10 has a filling of sand 13.

A current supply wire or conductor 14 is connected to the electrical contact 11 and to the external current supply conductors 7.

The external current conductors 7 are each connected via a metal strip 8 to the current supply wire 14. The strip 8 can be more readily adapted to the relative position of the external current conductors 7 than the rigid current supply wire 14.

In the embodiment shown, the metal strip of, for example, nickel has a plurality of fingers formed by cuts in the metal strip. As a result of which the strip 8 can be even more readily adapted to the external current conductors 7. Each external current conductor is connected to an individual finger 9.

The lamp shown is a film studio lamp consuming during operation at 120 V a power of 5 kW. The lamp reached the calculated lifetime without damage of the pinched seal.

Figure 2:
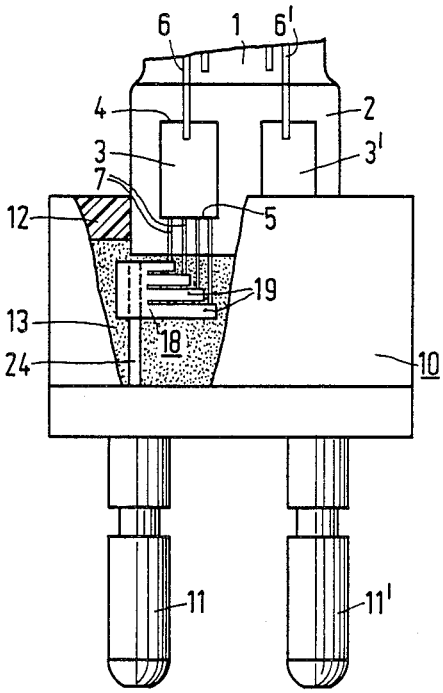
FIG. 2 shows a fragment of a variation of the lamp shown in FIG. 1.

In FIG. 2, parts provided with the same reference numerals are identical to those of FIG. 1. The current supply wire 24 is a straight wire connected to a striop 18 of metal, for example nickel, which is provided with fingers 19. Each finger is connected to a respective external current conductor 7.

Figure 3:
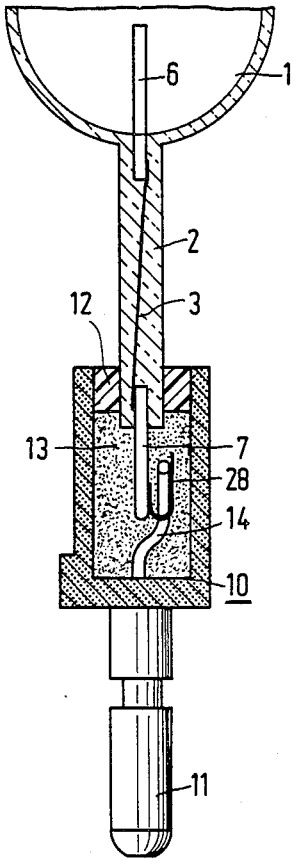
FIG. 3 shows a fragment of a variation of the lamp shown in FIG. 1 in sectional view taken on the line A—A.
Figure 4:
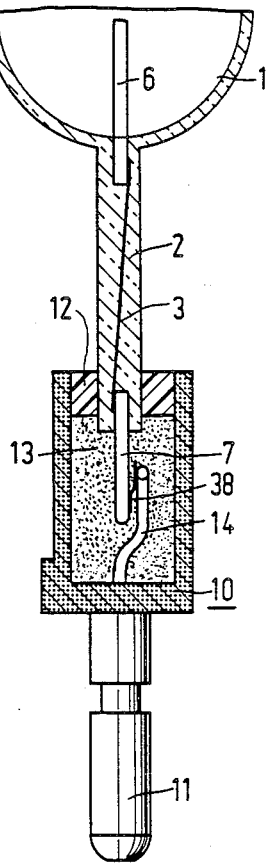
FIG. 4 shows another embodiment of the lamp of FIG. 3.

In FIG. 3, reference numerals corresponding to those in FIG. 1 denote like parts. A metal strip 28 is welded to the free end of the external current conductor 7 and extends through a U-shaped bend to the pinched seal 2. The strip 28 is welded near the pinched seal 2 to the rectangularly bent (cf. FIG. 1) current supply wire 14. FIG. 4 differs from FIG. 3 only in that the metal strip 38 is not bent into the form of a U.

In FIGS. 3 and 4, the metal strip 28 and 38, respectively, may be a strip which is connected to each of the several external current conductors 7, as the case may be provided with incisions, or may be an individual strip for the one visible external current conductor. For the remaining external current conductors 7 not visible in the drawing, a similar respective metal strip 28 and 38 is then present.

What is claimed is:

1. In an electric lamp having a lamp envelope sealed in a gas-tight manner and having a pinch seal, a light source disposed within said lamp envelope, an internal conductor connected to said light source and having an end portion extending into said pinch seal, a plurality of external conductors extending from said pinch seal to the exterior and terminating at free ends, a metal foil extending within said pinch seal connecting said internal conductor and said external conductors, and a lamp cap in which said pinch seal is secured and having an electric contact, wherein the improvement comprises:

a current-supply conductor connected to said electrical contact on said lamp cap and extending proximate said external current-supply conductors; and a flexible conductor flexibly connecting said current-supply conductor and said external conductors.

2. An electric lamp as claimed in claim 1, wherein said flexible conductor comprises a respective metallic strip flexibly connecting each external conductor to said current-supply conductor.

3. An electric lamp as claimed in claim 1, wherein said current-supply conductor has a portion extending transverse to said external conductors and spaced closer to said pinch seal than said free ends of said external conductors, and said metallic strips extend from said free ends of said external conductors towards said pinch seal and are connected to said transverse portion of said current-supply conductor.

4. An electric lamp as claimed in claim 2, wherein said current-supply conductor has a portion extending transverse to said external conductors and spaced closer to said pinch seal than said free ends of said external conductors, and said flexible metallic strips are U-shaped and extend from said free ends of said external conductors away from said pinch seal, curve back towards said pinch seal, and are connected to said transverse portion of said current-supply conductor.

5. An electric lamp as claimed in claim 1, wherein said current-supply conductor has an end portion extending parallel to said external conductors and said metallic strips extend transversely between said parallel end portion and said external conductors.

6. An electric lamp as claimed in claim 1, wherein said flexible conductor comprises a metallic strip having a plurality of fingers are connected to a respective external conductor.

7. An electric lamp as claimed in claim 5, wherein said current-supply conductor has a portion extending transverse to said external conductors and spaced closer to said pinch seal than said free ends of said external conductors, and said metallic strip extends from said free ends of said external conductors towards said pinch seal and is connected to said transverse portion of said current-supply conductor.

8. An electric lamp as claimed in claim 5, wherein said current-supply conductor has a portion extending transverse to said external conductors and spaced closer to said pinch seal than said free ends of said external conductors, and said metallic strip is U-shaped and extends from said free ends of said external conductors away from said pinch seal, curves back towards said pinch seal, and is connected to said transverse portion of said current-supply conductor.

9. An electric lamp as claimed in claim 5, wherein said current-supply conductor has an end portion extending parallel to said pinch seal and said metallic strip extends transversely between said parallel end portion and said external conductors.

10. In an electric lamp having a lamp envelope sealed in a gas-tight manner and having a pinch seal, a light source disposed within said lamp envelope, an internal conductor connected to said light source and having an end portion extending into said pinch seal, a plurality of external conductors extending from said pinch seal to the exterior and terminating at free ends, a metal foil extending within said pinch seal connecting said internal conductor and said external conductors, and a lamp cap in which said pinch seal is secured and having an electrical contact, wherein the improvement comprises:

a current-supply conductor connected to said electrical contact on said lamp cap and extending proximate said external current-supply conductors; and a flexible metallic planar strip flexibly connecting said current-supply conductor and said external conductors.

* * * * *